US007246400B2

(12) United States Patent
Ryan

(10) Patent No.: US 7,246,400 B2
(45) Date of Patent: Jul. 24, 2007

(54) HYGIENIC TOOTHBRUSH WITH COVER

(76) Inventor: Patrick Clarkson Ryan, 6646 W. Fall Rd., Altamont, NY (US) 12009

( * ) Notice: Subject to any disclaimer, the term of this patent is extended or adjusted under 35 U.S.C. 154(b) by 0 days.

(21) Appl. No.: 11/023,166

(22) Filed: Dec. 28, 2004

(65) Prior Publication Data

US 2006/0137122 A1 Jun. 29, 2006

(51) Int. Cl.
*A46B 17/04* (2006.01)

(52) U.S. Cl. ..... 15/185; 15/184; 132/308; 132/311

(58) Field of Classification Search ..... 15/184, 15/185; 132/308, 311
See application file for complete search history.

(56) References Cited

U.S. PATENT DOCUMENTS

| | | | | | |
|---|---|---|---|---|---|
| 543,028 | A | * | 7/1895 | Laws | 132/308 |
| 1,503,134 | A | * | 7/1924 | Ryan | 206/362.3 |
| 1,960,807 | A | * | 5/1934 | Cole | 15/185 |
| 2,651,070 | A | * | 9/1953 | Zimmerman | 15/185 |

FOREIGN PATENT DOCUMENTS

| | | | |
|---|---|---|---|
| FR | 2785776 | * | 5/2000 |
| GB | 2233549 | * | 1/1991 |
| GB | 2234893 | * | 2/1991 |
| WO | 90/12522 | * | 11/1990 |
| WO | 03/043460 | * | 5/2003 |

* cited by examiner

*Primary Examiner*—Mark Spisich
(74) *Attorney, Agent, or Firm*—GFD Patents LLC; Gerald F. Dudding

(57) ABSTRACT

The present invention is a hygienic toothbrush with cover, which utilizes a uniquely designed novel brush cover to keep the brush head bristles free of harmful particles and contaminants when not in use. The unique cover design allows for bristles to dry through utilization of finely woven mesh/screen-like side panels which allows the largest surface area of the brush head bristles to be exposed to the maximal amount of airflow without risk of contamination. The desired effect of faster drying reduces the ability of bacterial agents to grow on the brush bristles. The unique feature of the cover always remaining fastened to the brush handle helps prevent the contamination of the cover which happens when it is set upon a contaminated surface, and also accomplishes the desired goal of encouraging consistent use. When the toothbrush is being used, the cover is conveniently stored within the handle in a storage compartment, always remaining with the toothbrush.

30 Claims, 3 Drawing Sheets

Fig. #1
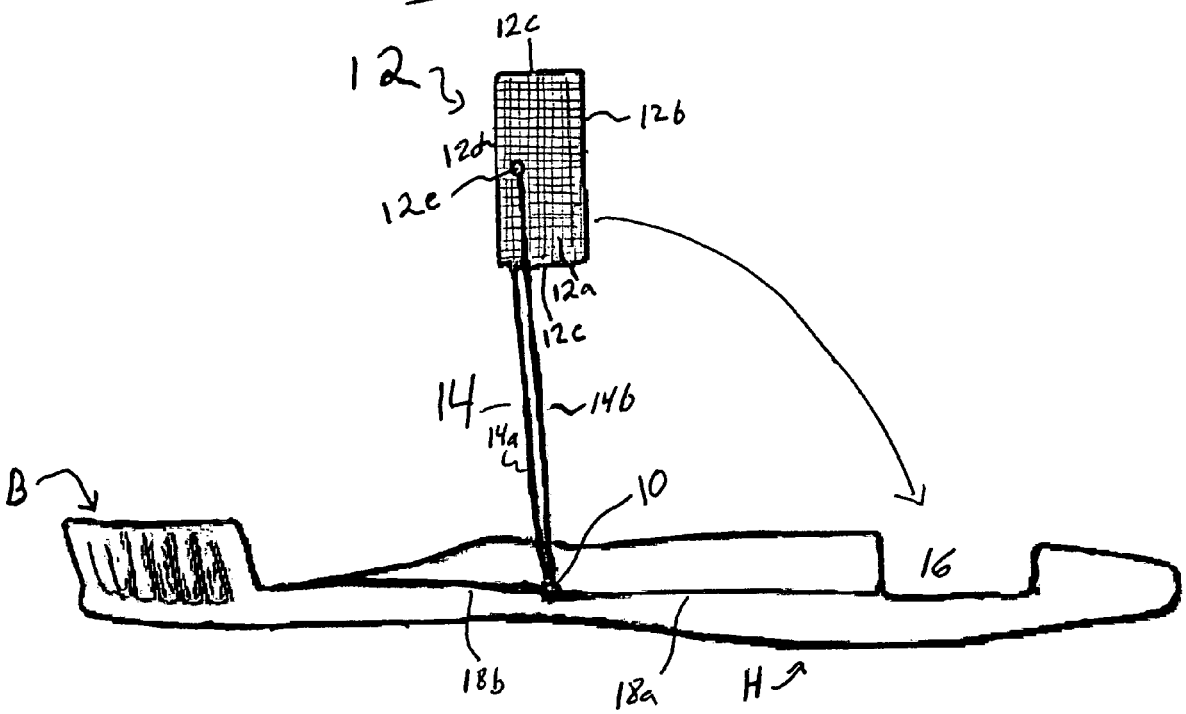
Fig #2
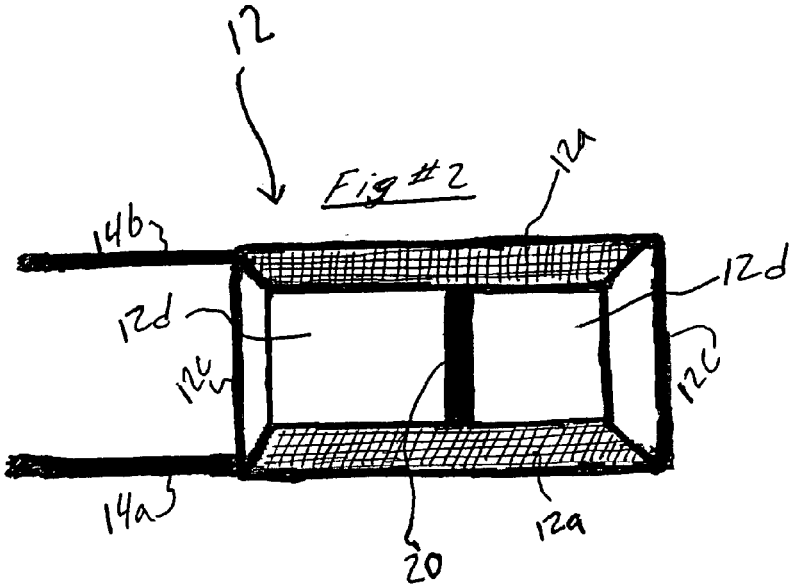

Fig #3
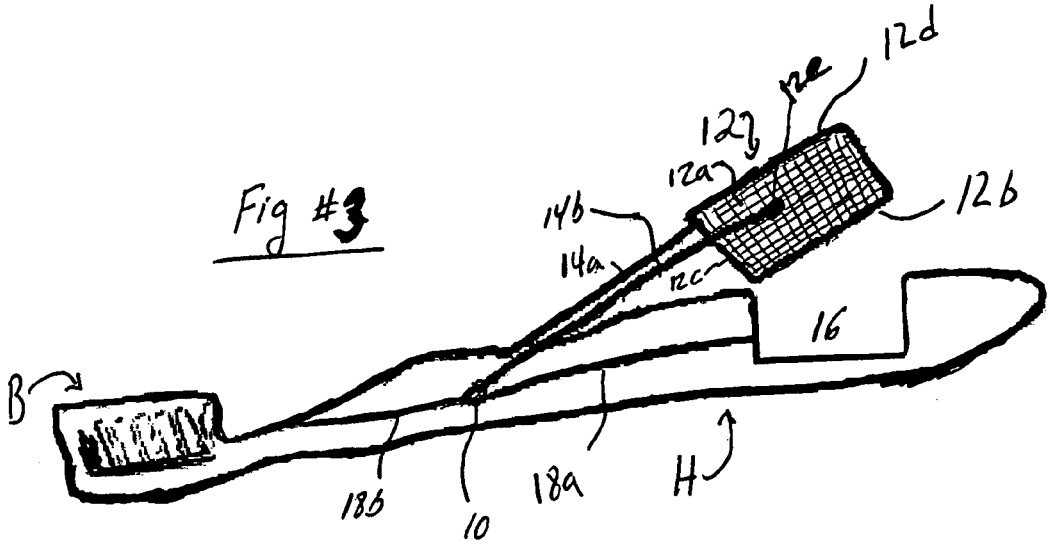
Fig #4
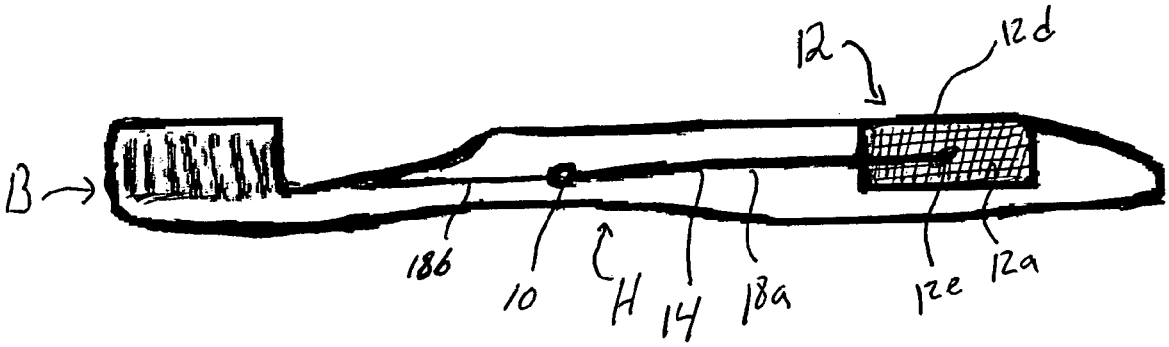

Fig #5
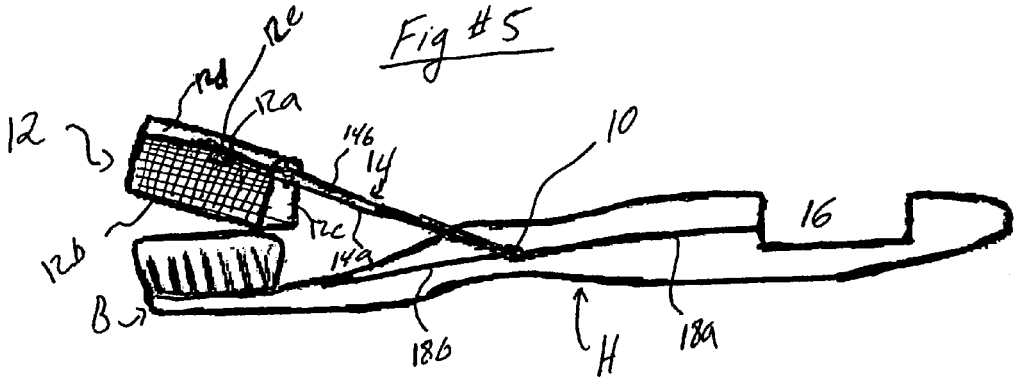
Fig #6
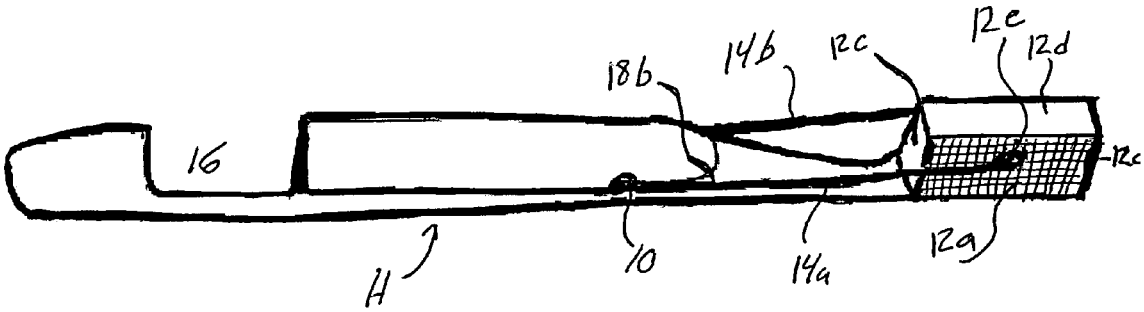

HYGIENIC TOOTHBRUSH WITH COVER

BACKGROUND

1. Field of Invention

This invention relates to devices used for Hygienic Protection of a toothbrush, more specifically to a toothbrush utilizing a cover to achieve such hygienic effect, for the primary purpose of protection against airborne contaminants, as well as harmful bacterial and viral agents.

2. Description of Prior Art

Toothbrushes have been used for many years to clean ones teeth. Only in the more recent past has the importance of a sanitary brush become well known. Toothbrushes are often stored in the bathroom and a Bathroom can be a very unclean place. Even if it appears to be clean on the surface airborne contaminants, viral agents, and bacterial agents abound and thrive under such conditions. These same airborne contaminants (ie. Fecal material from a flushed toilet), bacterial and Viral agents are the cause of Illness and Disease. There is a need for a hygienic toothbrush that is economical, easily used and effective in prevention of bacterial and viral contamination.

More recently Hygienic Toothbrushes or related devices have been developed and used to clean, or keep toothbrushes clean and sanitized, yet none of these prior art inventions has been able to achieve any significant degree of commercial success due to one or more of the inherent problems/flaws discussed more thoroughly below.

It has been found that many of the prior art inventions are simply inadequate in preventing contamination of the toothbrush. Many are inadequate in preventing bacterial growth on the bristle head due to poor ventilation (poor airflow) allowing bacterial growth on the brush head. Worse yet, Some Prior art inventions don't ventilate their covers at all, allowing bacteria growth to flourish. Bacterial growth is aided by warm moist conditions. In addition, many prior art inventions simply take up too much space; they are "space-inefficient". In a bathroom, or elsewhere, space is a limited commodity, especially countertop space.

Much of the prior art is complex and/or expensive to manufacture, this expense of course is being passed on to the consumer, and preventing mainstream acceptance. In addition to this, many are complex enough to use to become a hassle to the user, thereby preventing mainstream acceptance. In general, an easy to use product will gain acceptance faster than a complex one, especially when dealing with an everyday, mundane task of brushing ones teeth. Furthermore, many of the prior art inventions are too unconventional, and depart too much from the mainstream toothbrush that the brushing public has come to know and become comfortable with. In short, they are too far off the mainstream to gain public acceptance.

Please consider the following prior art inventions in light of the preceding discussion:

Much of the prior art can be recognized as disinfecting containers/storage holders for one or more toothbrush(s). As a group they are bulky, that is they take up unnecessary countertop and or wall space, and as mentioned space is a limited commodity. Such disinfecting containers create countertop clutter. Additionally, many of them are designed such that the brush head is to soak in a sterilizing liquid. Soaking the bristles makes them less stiff, and diminishes their ability to clean as well as a dry, stiffer bristle does. In addition to this many of the prior art inventions in this grouping are complex and expensive. Most of them also have poor ventilation, which inhibits the drying of the brush, making it an easier place for bacterial contaminants to flourish (Bacteria thrive in warm moist conditions, and the longer the toothbrush remains moist when exposed to air the more chance that bacteria will colonize in such a place.) They are also not easily transportable if the user is traveling. Additionally, they are often messy to maintain, especially if utilizing a liquid disinfectant. The following prior art inventions share one or more of the above shortcomings.

U.S. Pat. No. 4,997,629 to Marchand, et al (1991) is a canister which utilizes a sterilizing liquid for storage and sterilization of the container.

U.S. Pat. No. 5,023,460 to Foster et al, (1991) Is a toothbrush sanitizing container utilizing ultraviolet lights to sterilize the toothbrush, is large and bulky, very complex, and expensive.

U.S. Pat. No. 6,099,813 to Gipson (2000), is an expensive and complex toothbrush holder and sanitizer.

U.S. Pat. No. 5,882,613 to Gipson (1999) features a toothbrush sterilizing container, where the toothbrush is immersed in disinfecting liquid—this softens the bristles (making them not as effective; it also is bulky, expensive and messy.

U.S. Pat. No. 5,107,987 to Palazzalo (1992) features a container utilizing a liquid disinfectant for the brush to soak in. This is messy, takes up additional space, and softens the bristles from soaking.

U.S. Pat. No. 5,333,742 to Piedmont (1994) utilizes a mounting plate that dispenses plastic covers. The user must screw the mounting plate into the wall thereby damaging the wall. Additionally, this prior art invention also uses Plastic bags, which have questionable ventilation, are messy, and have to be replaced at the expense and inconvenience of the user.

U.S. Pat. No. 4,888,487 to Ritter (1989) is a sterilizing container utilizing UV lights to sterilize the toothbrush head. The invention is unnecessarily complex, and expensive.

U.S. Pat. No. 4,845,859 to Evans (1989) is a toothbrush storage and dryer system that uses light bulbs to dry the bristles. The invention is bulky, and costly to maintain.

U.S. Pat. No. 5,127,521 to Borgue (1992) is a container that uses UV light to sterilize. Like Ritter (U.S. Pat. No. 4,888,487) the invention is bulky, and costly to maintain.

U.S. Pat. No. 5,126,572 to Chu (1992)

Is another a container that uses UV light to sterilize, and has the same shortcomings as Ritter (U.S. Pat. No. 4,888,487)

U.S. Pat. No. 4,396,238 to Torruella (1983) is Bulky, and not economically manufactured.

U.S. Pat. No. 4,816,648 to Dusabek (1989) Uses Heat to disinfect and is expensive complex and Bulky U.S. Pat. No. 5,086,916 to Gray (1992) features a Toothbrush Sterilization unit and mounting bracket—it is not easily transportable and is, Bulky, expensive, messy, and Complex.

U.S. Pat. No. 5,505,301 to Foley (1996) features a carrying case/container that is bulky and poorly ventilated.

U.S. Pat. No. 5,052,556 to Wilkinson (1991) Is a Toothbrush Traveling case that is Large and Bulky, and won't fit within a conventional toothbrush holder. This prior art invention also exhibits poor ventilation.

U.S. Pat. No. 5,771,521 to McNamee (1998) Features a sanitary brush cover system that is really a container. The invention groups multiple brushes together allowing for transmission of bacterial and viral agents. It is also large and Bulky.

U.S. Pat. No. 6,171,559 to Sanders (2001) is a sterilization storage unit, which utilizes a hot air drying system and microbial spray. This is expensive, unnecessarily complex, and expensive to maintain (battery operated) It is also bulky.

U.S. Pat. No. 6,119,854 to Prentice (2000) is a sanitary toothbrush storage unit with a liquid filled reservoir. It is bulky, messy, and has the effect of softening the bristles through soaking them in disinfectant, thereby diminishing the effectiveness of the bristles in cleaning between teeth.

U.S. Pat. No. 4,214,657 to Winston (1980) is a toothbrush holder and sterilizer that has the same problems as with others, in that the toothbrush bristles stay wet reducing their stiffness, and thereby reducing their effectiveness. Winston's Invention is two pieces, messy, requires maintenance (changing of sterilization fluid on regular basis), and is bulky.

U.S. Pat. No. 4,234,087 to Pandak (1980) is a combination toothbrush holder/carrier, which sits on countertop, and has the same aforementioned shortcomings as the others U.S. Pat. No. 4,585,119 to Boyinaton (1986) is another prior art invention that uses a Liquid sanitizing agent and has all of the shortcomings of Winston (U.S. Pat. No. 4,214,657)

Let it be known that after an exhaustive search of the available prior art I Have Not found any Single-piece Hygienic Toothbrush with cover that is permanently fastened. All prior art utilizes a cover system in which the cover separates from the main toothbrush unit—thereby encountering problems such as increased contamination when the cover piece must be set on the contaminated countertop, or inconveniently held during the entire brushing period.

All of the following prior art has a cover unit that is a separate piece than the toothbrush itself, and is not permanently attached in any fashion. All of the following Prior art has the problem of temporary storage of the bristle cover while brushing is taking place (My hygienic toothbrush with cover solves this problem). It is a problem because the cover is otherwise placed on the countertop or like surface, and contaminated with harmful bacteria. Additionally, if the bristle cover is not permanently fastened to the toothbrush it may easily be lost rendering it useless to the owner. A bristle cover that is always conveniently and unobtrusively stored with the brush is more likely to be used, and therefore more effective. Furthermore, the prior art inventions within this category all have relatively poor ventilation of the covering mechanism, making it easier for harmful bacteria to flourish.

Please consider the following prior art in light of the immediately preceding discussion. All of the following utilize a cover that is completely separable from the Toothbrush itself, none of them are permanently fastened to the toothbrush structure, as is the present invention. Other shortcomings of the prior art are as discussed.

U.S. Pat. No. D343296 to Schneider (1994) is a large bulky cover where the ventilation slots at the top of the cover allow airborne contaminants to settle through ventilation slots onto the bristles/brush head.

U.S. Pat. No. 4,408,920 to Walther (1983) has poor ventilation.

U.S. Pat. D351286 Tapocik (1994) is a toothbrush Cover with poor ventilation, and is bulky.

U.S. Pat. D351286 to Tiramani, Et al (1992) is large and bulky, and won't fit in most toothbrush holders.

U.S. Pat. No. 5,044,386 to Nelson (1991) has a poor ventilation system.

U.S. Pat. No. 4,275,750 to Clark (1981) features a separate Toothbrush cover with poor ventilation and a bulky handle, which won't fit in conventional toothbrush holders.

U.S. Pat. No. 5,924,567 to Wenum (1999) features a reuseable storage cap that is not fastened to the toothbrush, and that has no internal storage compartment to store the cap during brushing.

U.S. Pat. No. 4,835,813 to Lorenzana, Et al (1989) exhibits a protective cover for a toothbrush having poor/inadequate ventilation.

U.S. Pat. No. 5,044,039 to Picard (1991) also exhibits a poorly ventilated cover for toothbrush Bristles that are not permanently fastened to the brush structure itself.

U.S. Pat. No. 5,048,144 to Andrews (1991) features frictionally engaging sides gripping the bristle head to form temporary attachment. The attachment to the brush structure is in no way permanent, and can easily be lost or contaminated since it is not attached permanently. When lost the cover is of course useless to it's would be user.

Additionally, there is no top piece to the cover. The bristle cover is ventilated through the top most portion, which allows free floating airborne contaminants to settle on and contaminate the bristles. My hygienic toothbrush with cover covers the topmost portion, and ventilation is on the sides of the cover, where particles are less likely to settle, and where the most surface area is.

U.S. Pat. No. 5,779,046 to Plakos (1998) uses a decorative toothbrush guard featuring a hinged cover, which is not permanently attached. It has inadequate ventilation, is bulky, and suffers from the same shortcoming as the other previously mentioned art.

U.S. Pat. No. 5,960,801 to Vermooten (1999) Features a complex toothbrush accessory/enclosure that uses a sanitizing tablet, which turns gaseous to sterilize the brush head. Utilization is expensive and inconvenient for the user.

U.S. Pat. No. 4,421,433 to Villanueva (1983),U.S. Pat. No. 6,102,203 to Marro (2000), U.S. Pat. No. 6,129,090 to Pillar Et al (2000), and U.S. Pat. No. 6,026,532 to Catanzaro (2000) all utilize a separable cover piece, that is not permanently attached in any fashion to the toothbrush structure resulting in the aforementioned problems. Other shortcomings mentioned in previous prior art discussion are readily apparent with these prior art inventions as well.

U.S. Pat. No. 5,887,601 to King (-1999) features a two Piece Toothbrush, similar to separated Cover/Cap above Prior art. The same problems as in the immediately preceding prior art exist here (ie. Contamination by placing on countertop, Loss of cover due to not being permanently attached, etc.). Additionally, the adjoining pieces used to form the toothbrush are meant to be able to be deconstructed, and can easily come apart during brushing resulting in injury.

U.S. Pat. No. 5,139,142 to Simon (1992) features a disposable Toothbrush Cover for a toothbrush bristle head. The Simon invention has limited ventilation resulting in increased risk of bacteria growth on the bristle head. Furthermore, disposability means constant replacement and expense, this is an inconvenience to the user both economically, as well as physically. Also, the would be user is not protected when it runs out of the disposable item. It is expensive and, prone to countertop contamination when the user temporarily places the cover on the countertop. Additionally, the dispensing mechanism is bulky, and unsightly/unattractive.

Similar to the above mentioned prior art "self-contained" toothbrushes utilizing a cover system U.S. Pat. No. 5,832,940 to Embry et al; (1998) utilizes a telescoping cover for toothbrush. This invention like the above prior art has a separate cover and the resulting shortcomings apply to this prior art invention as mention in the preceding discussion relation to toothbrush covers that were not permanently fastened to the brush structure.

Additionally, Embry invention suffers from poor ventilation, it is unnecessarily bulky, and is unnecessarily complex and expensive.

U.S. Pat. No. 6,671,920 to Pearlman, Et al (2004) like Embry (U.S. Pat. No. 5,832,940) features a telescoping "self-contained" toothbrush. It has the same problems and additionally has poor ventilation. It furthermore, has a necessarily wide base so can receive the telescoping components preventing it from fitting into conventional toothbrush holders. Additionally, the wide base also makes it uncomfortable to hold.

The stability of the brush, when in use, is also compromised due to telescoping feature.

Much of the remaining relevant prior art can be categorized as Collapsible Toothbrushes or Foldable Toothbrushes. All Such prior art inventions to date inherently have the following problems that they all share:

They are less sturdy than single piece construction toothbrushes, and they can easily lead to injury. Brushing is often a vigorous exercise. Any compromise in sturdiness, or resulting wobbliness may easily lead to injury of the user. If the hinged mechanism comes apart during use, or even wobbles a little this can result in gum, tooth, and/or mouth injury. Additionally, because all of the prior art folding and collapsible toothbrushes fold or collapse into themselves they are as a result more bulky, and won't fit in a conventional toothbrush holder when folded/collapsed.

Furthermore, the folding/collapsible toothbrush prior art all have poor/inadequate air ventilation for the bristle head since the head of the brush disappears into a solid handle lacking ventilation completely, or at best is poorly ventilated. This of course facilitates the previously discussed problems of Bacterial and Viral contamination and growth. Finally, many are prohibitively expensive to the consumer.

Please consider the following relevant prior art in light of the immediately preceding discussion.

U.S. Pat. No. 4,866,809 to Pelletier (1989) exhibits a telescoping feature to collapse and extend the handle of the brush. This Telescoping feature is not as sturdy as a one piece, single construction/non-collapsible brush. Also the telescoping construction is more expensive and difficult to manufacture, has a wide base, which is uncomfortable to the user, and won't fit in a conventional toothbrush holder. Finally, the cover piece is removable, which results in the same problems associated with separable cover prior art previously discussed. The Pelletier prior art invention also exhibits poor ventilation.

U.S. Pat. No. 6,560,810 to Jacobson (2003) features a folding toothbrush that is hinged in the middle, which decreases its overall stability. Brushing is often a vigorous exercise. Any compromise in sturdiness/wobbliness may easily result in injury to the user.

Here, the cover piece is clumsily attached to handle, making the handle difficult to effectively use. Also, as a result of the width when in folded position it cannot be stored in a conventional toothbrush holder.

Finally, there also appears to be no or inadequate ventilation.

U.S. Pat. No. 5,476,333 to Mathews (1995) showcases another foldable toothbrush

Mathews exhibits all of the above-mentioned problems in U.S. Pat. No. 6,560,810 to Jacobson (2003) as well, as having the shortcomings of being expensive, complicated and messy to refill. Finally, the cover is not attached, and is awkwardly positioned.

U.S. Pat. No. 5,735,298 to Mayne (1998) features a Tri-fold multi purpose brush, which has the same problems and shortcoming discussed for foldable/collapsible toothbrushes.

U.S. Pat. No. 5,382,107 to Nian (1995) and U.S. Pat. No. 5,464,294 to Chee (1995) have the same shortcomings and problems as discussed above in the discussion on Collapsible toothbrushes and foldable toothbrush prior art.

Lastly, U.S. Pat. No. 4,780,923 to Schultheiss (1988) features a permanently attached cover system not compatible with a toothbrush. The Schultheiss invention is a dental instrument that has a cover/cap that is permanently attached towards the top of the dental instrument. The Cover does not completely recess into the handle of the toothbrush; Furthermore this design could not be effectively used with a toothbrush because the cover would be in such a position that it would be injurious to the toothbrush user, when brushing their teeth, could cut their gums etc. The cap/cover is permanently positioned in such a way that if used, as a toothbrush it would be in the user's mouth!

Another shortcoming of Schultheiss is poor/inadequate air ventilation.

The fact that Hygienic Toothbrush's utilizing cover systems are not in widespread use suggests that barriers exist to their acceptance/commercial production. This is because there are no products on the market that meet the main consumer criteria of inexpensiveness, effective, easy to store, easy to use, and are not a radical departure from the look and feel from the toothbrush that they have become comfortable with. Additionally, many prior art inventions in this category have failed to reach market, or have failed to gain commercial/consumer acceptance because of cost, difficulty of operation of the device, or difficulty to manufacture.

The Present inventor recognizes the need for a Hygienic Toothbrush with cover that addresses the aforementioned problems and disadvantages of the prior art. The present inventor also recognizes the importance of addressing these needs in a simple and low cost manor. My Hygienic Toothbrush with Cover achieves these goals, and others, while improving on all prior art. This becomes clear in the following section(s) of this application.

OBJECTS/ADVANTAGES

Accordingly, several objects and advantages of my hygienic toothbrush with cover follow:

It is an object of this inventor to provide a Cleaner and Healthier Toothbrush by allowing fewer harmful Bacteria and Contaminants on the brush when it is not in use. This object is hereby accomplished because the cover keeps airborne contaminants (ie. Fecal material, harmful bacterial and viral agents, and other bathroom contaminants) from settling on the brush bristles when brush is not in use. It is recommended (but not necessary) that a procedure of rinsing the brush head in an antiseptic/antibacterial (such as Listerine™) is used prior to placing the cover over the bristles to kill any bacterial/viral agents transferred from the users mouth. This procedure used in combination with the present invention will result in huge potential health benefits. Still another related advantage is that the present Hygienic Toothbrush with cover solves a major health concern in that it also prevents contamination by insects. The common housefly and other disease carrying insects love to frequent Bathrooms!

It is another object of this invention to provide the user with a Toothbrush Cover that is always with the brush. This is accomplished with my hygienic toothbrush with cover since it is permanently adjoined to the handle as detailed in the drawing figures, making it much more likely to be used on a consistent basis.

It is yet another object of this invention to provide a Toothbrush with a Cover, which provides better ventilation to allow the brush bristles to dry more quickly, thereby inhibiting bacterial growth on the brush bristles. Much of the prior art utilizes only a few small holes for ventilating purposes, leading to slow drying and a build up of bacterial growth. My hygienic toothbrush with cover has improved ventilation. The ventilating mesh/lattice material used in the my hygienic toothbrush with cover is on the sides of the brush head cover panels, exposing more surface area of the bristles to the air, allowing for faster drying. Also, because the ventilation mesh is on the side, less airborne contaminants are able to settle in through the holes, as does happen with inventions that ventilate through the top most portion of the cap/cover. This is also why the present inventor has proposed a solid plastic top portion of the cap in the main embodiment, to prevent the settling of airborne contaminants through the topmost portion of the cover.

It is still another object of this inventor to not radically depart from the mainstream look and feel of today's widely accepted toothbrush. My hygienic toothbrush with cover does not markedly change the look and feel of today's commercially popular toothbrush. It is the inventor's assertion that many developers of hygienic toothbrushes, and or related products, despite the need for them, have been unable to achieve widespread commercial or consumer acceptance due to radical and expensive departures from the mainstream product that they have used for years. My hygienic toothbrush with cover is not a radical departure from today's commercially accepted toothbrush in appearance and feel, but provides tremendous health benefits in a low cost and convenient manor. The Simplicity of my hygienic toothbrush with cover is a huge advantage over the more complex Prior art inventions.

It is another object of this inventor to produce a product that is inexpensive to manufacture, and will be inexpensive for the consumer. Many Prior art hygienic toothbrushes and toothbrush holders have not gained commercial acceptance because of price. My hygienic toothbrush with cover is inexpensive to manufacture, and can be done by use of inexpensive materials readily found on the market. My hygienic toothbrush with cover is constructed of various "plastic" materials, while the mesh side panels may be constructed of a fibrous woven or mesh like plastic material. Therefore it will be affordable to the mass market.

It is yet another object of this inventor to create a hygienic toothbrush with cover that will fit in almost all of today's conventional toothbrush holders. This is accomplished due to my hygienic toothbrush with cover's slim design, and the fact that no added girth is added to the toothbrush handle preventing it from fitting within today's holders. This means less clutter, and less countertop space used for the user of my hygienic toothbrush with cover.

It is still another object of the inventor to provide a toothbrush with cover that is always in one piece. Since my hygienic toothbrush with cover is one piece it is stronger and more stable than a collapsible or two-piece Toothbrush. Another advantage of the Toothbrush and toothbrush cover being permanently attached is that one piece also means that the bristle cover need never be separated from the toothbrush structure, therefore it doesn't need to be set on a dirty/contaminated surface such as a bathroom countertop when the brush is in use. A Virus can remain alive on the countertop for several hours or more! Any object coming into contact with the countertop can easily result in it to becoming contaminated, therefore putting the health of the toothbrush user at risk. In the case of my hygienic toothbrush with cover, the brush cover is simply maneuvered into the brush handle for a cleaner temporary storage until the user is finished brushing. When the user is not brushing their teeth the brush cover is easily maneuvered to cover and protect the bristles. Yet another major advantage of the permanent attachment feature of my hygienic toothbrush with cover is that by the cover always being attached to the brush handle it will actually be used! A major disadvantage for prior art invention users of a hygienic toothbrush utilizing a separable cover system is that separated covers may be used sporadically/inconsistently, significantly lessening the benefits of covering the brush head. Additionally, Two-piece Toothbrushes are cumbersome, and two piece Toothbrushes/cover may result in the cover being lost rendering it ineffective.

It is this inventor's belief that it also lessens the consumers perceived value.

After an exhaustive search of the available prior art I Have Not found any Single-piece Hygienic Toothbrush with cover. All others that utilize a cover system do so in a fashion in which the cover separates from the main toothbrush unit, when the process of brushing ones teeth is taking place. The disadvantages to this have been thoroughly discussed in this application.

It is another object of the inventor to prevent cross contamination between toothbrushes being stored in close proximity. Brushes in a conventional Toothbrush holder are often in close contact with other brushes. Even the briefest contact can cause a transmission of bacterial or viral agents from one brush head to another. A family member that is sick or "coming down with something" can easily contaminate another family members brush with these harmful bacterial/viral agents. My hygienic toothbrush with cover prevents this contact and therefore prevents the transmission of these agents and illness associated with them.

It is yet another object of the inventor for the invention to be attractive and yet unassuming in appearance. The general appearance of much of the prior art is not attractive, and often a would be purchaser misses out on potential benefits for this reason. With my hygienic toothbrush with cover, the cover almost completely disappears when not in use, and becomes part of the brush handle. Thus a toothbrush with increased functionality, which does not depart from the mainstream look and feel of today's widely accepted commercially successful brushes.

It is still another object of this inventor to provide a hygienic toothbrush with an attached cover that is easy to use. This is achieved with my hygienic toothbrush with cover, in that, even a small child can maneuver the attached cover into the correct positions. Much of the prior art is prohibitively complex, especially for children. My hygienic toothbrush with cover is practical and efficient.

Yet another object of the present inventor is to provide an everyday use toothbrush that would also be suitable for travel. With my hygienic toothbrush with cover the cover for the bristles allows this by keeping dust, dirt, germs and other contaminants off of the toothbrush bristles when stored in a suitcase or other travel accessory. The cover prevents the toothbrush bristles from contacting contaminated surfaces. My hygienic toothbrush with cover is also convenient and easy to carry for travel purposes. This is achieved since my hygienic toothbrush with cover is much less bulky than prior art travel toothbrushes.

It is still another object of the inventor to produce a cover that is space efficient. The cover of my hygienic toothbrush with cover is constructed in such a way that it is spacious enough so that the bristles do not contact the inner surface of the cap, when in a closed/covering position; thereby inhibiting bacterial growth, yet small enough so that it fits within the handle structure, completely out of the way, when the user is brushing ones teeth.

It is yet another object of the present inventor to provide a stable Hygienic toothbrush with cover to prevent injury. Many prior art Hygienic Toothbrush inventions have gone the route of Folding travel brushes. These are cumbersome and are not stable. Over time the hinge weakens and the brush wobbles. My One-Piece not hinged brush with cover is more stable.

It is still another object of the present inventor to produce a hygienic toothbrush with cover that is easy to clean. Much of the prior art is difficult to clean. It is extremely important to keep any cover or container clean in order to prevent bacterial build up. My hygienic toothbrush with cover has few parts, and is easy to clean.

It is still another object of this inventor is to promote consistent use of a covering system to prevent contamination of the toothbrush bristles. This is accomplished with my hygienic toothbrush with cover by having the cover permanently attached to the toothbrush handle, which serves as a reminder to cover the bristles for protection after each use.

Other objects, features, and advantages will become obvious to those skilled in the art from the following descriptions and accompanying drawings.

SUMMARY

My Hygienic Toothbrush with cover is the only known single piece construction toothbrush with a cover, that is permanently attached and has a convenient storage chamber for that cover within it's handle. The result is a toothbrush bristle head that is kept free of both surface contaminants and airborne contaminants; leading to a cleaner and healthier toothbrush.

The added benefits of features for improved ventilation, permanent attachment, and storage of the toothbrush cover unit result in a bristle head that is kept free of contaminants, and dries quickly thereby helping prevent bacterial growth on the bristle head. The cover unit of the present invention is also used with much more consistency because it is permanently attached to the toothbrush itself. More consistency in use results in better oral hygiene than does inconsistent use as often happens with toothbrush covers that are not permanently attached.

Additionally, the present invention is easy to manufacture, Economical for the consumer, unobtrusive, convenient, space efficient, easy to use (even for children) easy to clean, suitable for travel purposes, practical, and safe.

DRAWING FIGURES—BRIEF DESCRIPTION OF DRAWINGS

FIG. 1 shows a side view of the invention with the protective cover unit (12) in position to be maneuvered into the storage compartment (16).

FIG. 2 shows an enlarged view of the inside of the cover unit (12).

FIG. 3 shows a side view of the invention, with the cover unit (12) almost in the cover storage compartment (16).

FIG. 4 shows a side view of the invention with the cover (12) fully in position within the cover storage compartment (16). The invention is ready for brushing action to commence.

FIG. 5 shows a side view of the invention with the protective cover unit (12) almost in the position of covering the bristles (B) of the toothbrush.

FIG. 6 shows a side view of the invention with the cover unit (12) fully covering the bristles (B) of the toothbrush. The toothbrush is ready for storage, and awaiting its next usage, while remaining in a fully protected state.

The numbers and letters within the drawing figures represent as follows:

B-Bristles of the Toothbrush

H-Handle of the toothbrush

10-Hole in the handle (H) of toothbrush invention, through which connecting means (14) passes.

12-The Cover Unit

12*a*-Side panel(s) of the cover unit

12*b*-Open side of the Cover Unit for receiving brush bristles (B)

12*c*-End(s) of cover unit

12*d*-Backside of the Cover Unit

12*e*-Hole in the Cover Unit

14-The Connecting Means

14*a*-left side connecting means

14*b*-Right side Connecting Means

16-Storage Compartment for Cover Unit

18-Fitting Groove(s) for locking connecting means (14) into the stationary position; whereas through the use of said connecting means and fitting grooves, the cover unit is held in place either within the storage compartment, or so that it is held into place and covering the bristles (B).

18*a*-right back fitting groove

18*b*-left back fitting groove

18*c*-right front fitting groove

18*d*-left front fitting groove

20-The Pin Axle on which the cover unit is able to rotate a full 360 degrees. (The pin axle in the preferred embodiment is a part of the connecting means (14) and is substantially perpendicular to connecting means designated by reference 14*a* and 14*b* in the drawings. It is noted that the pin axle (20) can also be a separate and distinct piece in an alternative embodiment of the invention.

DETAILED DESCRIPTION OF INVENTION/DRAWINGS

There is shown a Toothbrush comprised of a Bristle head (B) and a Handle (H). The Handle (H) having a hole (10) as detailed in FIG. 1, and a hollow compartment (16).

The Connector Means (14) is threaded through the hole (10) in the handle (H) and attached to the cover (12) through holes (12*e*) located in the cover piece (12), as detailed in FIG. 1 such that the cover piece (12) is free to rotate 360 degrees on the pin axle portion (20) of the connector means (14) as detailed in FIG. 1 and FIG. 2. The Pin axle (20) may be separate and distinct part of the connector means (14), or a continuous part of the connector means, which is bent/shaped to create substantially 90 degree angles at the point where the cover attaches as in FIG. 2.

The Cover Piece (12) is made up of 5 sides, as detailed in the drawing figures. The two side panels (12*a*) being substantially ventilated to expose maximum bristle surface area to the air, and yet to minimize possibility of contamination of said bristle head. The two end panels' (12*c*) being of substantially solid construction, and not perforated/ventilated. The back panel (12*d*) is solid to prevent contaminants from infiltrating, and there is no front panel, since this is the bristle-receiving end of the cover unit.

Although specific features of the invention are shown in some drawings and not others, this is for convenience only, as each feature may be combined with any or all of the other features in accordance with the invention. Other embodiments will occur to those skilled in the art that are within the following claims.

Operation—Main Embodiment

The use of the invention at hand is as follows, and the user takes the following steps prior to placing the brush end of the toothbrush in ones mouth and commencing brushing action.

First, the user places one or more fingers and a thumb in a pinching motion on the cover (12). Next, using a pulling motion, the user pulls the cover (12) away from the brush head and into a position such that cover (12) is between the brush head/Bristles (B) and the Handle (H). The user then rotates the cover (12) on the pin axle (20) 180 degrees, such that the open face of the cover, that was formerly protecting the bristles (B), is now facing the hollow compartment (16) in handle (H). Next, the user gently pushes the cover (12) open face down, into the hollow compartment (16) until the backside of the cover (12*d*) is flush with handle (H). Then, the user applies slight pressure onto the connecting means (14), pushing them into the fitting grooves (18) of the handle (H), such that they lock into place, and are flush with the handle (H). My Hygienic Toothbrush with Cover is now ready for brushing use.

After the brushing process is complete, the user repeats the pinching motion using one or more fingers and thumb, pulling the cover (12) from the hollow compartment (16), such that the cover (12) is positioned between the handle (H) and the brush head bristles (B). The user next rotates the cover (12) 180 degrees, such that the open face of the cover piece (12) is facing the bristles (B). Then, gently push the cover (12) over the bristles (B) and snap the connector means (14) into the fitting grooves (18) of the handle (H). The process is now completed. The toothbrush is then returned to its place of storage fully protected.

CONSIDERATIONS

The ventilation holes in the cover should be large enough to permit adequate airflow to promote fast drying of the bristles on the brush head, but small enough to prevent airborne contaminants from entering the protected area. The Hole (10) in the handle (H) should be positioned such that the cover unit (12) can complete it's stated objectives. The Connecting means should be of adequate length and positioning so that they may accomplish their stated objectives.

CONCLUSION, RAMIFICATIONS, AND SCOPE

Accordingly, the reader will see that my hygienic toothbrush with cover unit is the only known existing hygienic toothbrush with a cover unit that is permanently attached to the toothbrush structure. This unique feature along with greatly improved ventilation has resulted in the achievement of the ultimate objectives of a cleaner and healthier toothbrush for the user. The use of my hygienic toothbrush with cover unit keeps the bristles free of contaminants and diminishes the chance of bacterial growth on same bristles. Additionally, The permanent attachment feature of my hygienic toothbrush with cover unit yields several benefits not found in the prior art. The permanent attachment of the cover unit to the toothbrush structure prevents the cover from being lost, or being contaminated by being placed on a contaminated surface while the brushing action is taking place. Secondly, the permanent attachment feature promotes the usage of itself by always being visible and physically with the brush, whereas prior art utilizing covers that separate from the brush structure, often are not used consistently and easily fall prey to contamination by way of contact with a dirty surface.

Furthermore, my hygienic toothbrush with cover unit is easy to use, even for children. It is convenient, safe, practical and simple in structure. Additionally, my hygienic toothbrush with cover is suitable for travel, since it achieves the travelers objective of keeping the bristles clean during travel, as well as being easily portable and space efficient. Still further, the unique cover unit storage compartment allows the brush cover to be stored without taking up any additional space, allowing my hygienic toothbrush with cover unit to fit in conventional toothbrush holders.

Additionally, my hygienic toothbrush with cover unit is easy and economical to manufacture since it is simple in structure and composed of materials which are readily available at low cost, making it affordable to the masses of consumers.

While my above description contains many specificities, these should not be construed as limitations on the scope of the invention, but rather as an exemplification of one preferred embodiment thereof. Many other variations are possible, only a few of which are briefly discussed in the "alternative embodiments" section of this application. Accordingly the scope of the invention should be determined not by the embodiments illustrated, but by the appended claims and their legal equivalents.

ALTERNATIVE EMBODIMENTS

There are many similar ways of attachment and use, which fall within the scope of this invention. For example, the pin axle may be the same continuous piece, as the connector means, piercing the cover piece, and continuing through the other side, or it may be a separate and distinct piece serving the purpose. Alternatively, the swivel means do not require an axle at all, but can be accomplished by way of an appropriate mold or fitting that turns within each other (similar to ball bearing fittings).

The fitting may simply be two holes on the inside of the cover that do not pierce the other side, but instead allow the axle to turn within these holes. In this case, the connector means may be fused directly to the outside of the cover itself.

Yet another conceivable alternative embodiment of the present invention would be as an attachable feature which allows the cover to be used and sold as an attachable piece-the cover complete with arms could be attached to the brush handle via a C Clamp or other suitable attachment means to perform a similar function.

The Brush Head Cover and Receiving Compartment (and hollow compartment in the handle) can be adjusted during manufacturing to accommodate various shapes of brush heads. i.e. diamond, conventional, trapezoidal, etc. The present invention can be made in any other color and/or designs.

Ventilation can be accomplished through ventilating of different cover panels, or by use of a different ventilating material, such as a fibrous material.

Alternatively, the connecting means could be a single connecting means, instead of the proposed dual connecting means.

There are many ways to attach the cover, or for that matter construct the present invention that should be obvious to those skilled in the art, which do not stray from the scope of the present invention. Accordingly, the present invention should not be limited by its drawings or the main embodiment.

What is claimed is:

1. An apparatus, comprising:

a.) a toothbrush, comprising an elongated handle at one end and a bristle head at an other end including a plurality of bristles extending from the head and including free ends spaced therefrom;

b.) a porous cover piece, having only one open side enabling the cover piece to be placed over the bristles, said cover piece having a non porous backside opposite the open side, and porous sides, wherein the porous sides are oriented such that they are generally parallel to the longitudinal axis of the handle and the non porous backside faces the free ends of the bristles when the cover piece is placed over the bristles; and c.) an elongated connector between the elongated handle and the porous cover piece, wherein the elongated connector has a first end pivotally connected to the elongated handle and a second end on which said porous cover piece swivels for selectively covering the bristles of the toothbrush.

2. The apparatus of claim 1, wherein the elongated handle has a hollow chamber for storage of said cover piece when brushing action is taking place.

3. The apparatus of claim 2, wherein the cover piece is positioned onto a swivel means for rotating the cover piece on the elongated connector, such that the open side of the cover piece faces the bristle head when brushing action is not taking place, and the open side faces a bottom of the hollow chamber when brushing action is taking place.

4. The apparatus of claim 3, wherein the swivel means for rotating is a pin or axle.

5. The apparatus of claim 4, wherein the pin or axle being either of the same piece as the elongated connector, or a separate and distinguishable piece from the elongated connector.

6. The apparatus of claim 5, wherein the pin or axle being adequate in length to span a width of the cover piece.

7. The apparatus of claim 2, comprising the cover piece and the storage chamber having a shape selected from the group consisting of a trapezoidal shape and a diamond shape.

8. The apparatus of claim 1, comprising the elongated handle having "Fitting Groove(s)" for the elongated connector to fit into, said elongated connector becoming flush with said elongated handle when brushing action is taking place.

9. The apparatus of claim 1, wherein the handle has a hole or other attachment means for attaching said elongated connector to the elongated handle.

10. The apparatus of claim 1, comprising a swivel means between the elongated connector and the cover piece, wherein the elongated connector and the cover piece have holes or fittings, for the elongated connector and the cover piece to swivel on.

11. The apparatus of claim 10, the cover piece being positioned on said swivel means for rotating the cover piece 360 degrees.

12. The apparatus of claim 10, wherein a pin or axle is fitted through the cover piece hole and, attached, or being part of, the elongated connector for connecting said cover piece to the elongated handle of the toothbrush.

13. The apparatus of claim 1, comprising the porous cover piece being made from a material selected from the group consisting of a mesh-like plastic material, a ventilated woven material, and a material having a plurality of small holes.

14. The apparatus of claim 1, comprising the cover piece being such that the bristles of the toothbrush don't touch the cover piece, but that said bristles are in very close proximity to said cover piece so that very little space is wasted between the bristles and said cover.

15. The apparatus of claim 1, comprising the elongated connector for connecting said cover piece to the elongated handle of toothbrush being of adequate stiffness to support said cover piece, yet still thin enough to not encumber.

16. A method for using the apparatus of claim 1, comprising:

providing the apparatus of claim 1;

covering the bristles with the porous cover piece for ventilating the bristles of the bristle head; and hygienically cleaning the teeth of the person by using a brushing action.

17. A toothbrush assembly, comprising:

an elongated toothbrush body having a bristle head at one end and a handle at a second end, the handle further including a storage compartment;

a cover including an open side enabling the cover to be placed over the bristles;

an elongated connector including a first end pivoted to the toothbrush body between the bristled head and the storage compartment and a second end coupled to the cover by a swivel coupling;

whereby the cover is movable between a first position wherein the open side of the cover faces the bristled head such that the cover is disposed over the bristles to protect them when not in use and a second position wherein the open side of the cover faces a bottom of the storage compartment so that the cover may be stored within the storage compartment when the brush is in use; and means operable between the toothbrush body and the connector for selectively retaining the cover in the first and second positions.

18. The toothbrush assembly of claim 17, wherein the elongated connector between the toothbrush body and the cover is permanently attached to the cover and to the toothbrush body.

19. A method of using the toothbrush assembly of claim 17, comprising:

a. providing the toothbrush assembly of claim 17;

b. replacably removing the cover from the bristle head and replacably placing the cover in the storage compartment, wherein the user removes the cover from the bristle head, rotates the cover on a pin axle of the connector 180 degrees, so that the open side of the cover, that was formerly protecting the bristle head, faces the storage compartment in the handle;

d. hygienically cleaning the teeth of the person by using a brushing action;

e. replacably removing the cover from the storage compartment and replacably placing the cover over the bristle head, wherein the user removes the cover from the storage compartment, and rotates the cover on the pin axle of the elongated connector 180 degrees, so that the open side of the cover, that was formerly protected by the storage compartment, faces the bristle head; and f. covering the bristle head with the cover.

20. The toothbrush assembly of claim 17, wherein the elongated connector comprises arms and the means operable between the toothbrush body and the arms of the connector for selectively retaining the cover in the first and second positions comprising fitting grooves, such that the arms of the elongated connector for connecting said cover to the handle of toothbrush click into the grooves and lock the cover into place in the storage compartment.

21. The toothbrush assembly of claim 20, wherein the cover complete with arms is attached to the handle via a C Clamp.

22. An apparatus, comprising:

a.) a toothbrush, comprising an elongated handle at one end and a bristled head at an other end;

b.) a porous cover piece, including an open side enabling the cover piece to be placed over the bristles; and c.) a connecting means between the elongated handle and the porous cover piece on which said porous cover piece swivels for selectively covering the bristles of the toothbrush, the elongated handle having "Fitting Groove(s)" for the connecting means to fit into, said connecting means becoming flush with said elongated handle when brushing action is taking place.

23. The apparatus of claim 22, comprising the connecting means for connecting said cover piece to the elongated handle of toothbrush being of a width, and length that fits snugly into the fitting grooves, such that the connecting means for connecting said cover piece to the elongated handle of toothbrush click into the grooves and lock the cover piece into place in a hollow chamber.

24. An apparatus, comprising:

a.) a toothbrush, comprising an elongated handle at one end and a bristled head at an other end;

b.) a porous cover piece, having only one open side enabling the cover piece to be placed over the bristles, said cover piece having a non porous backside opposite the open side, and porous sides, wherein the porous sides are oriented such that they are generally parallel to the longitudinal axis of the handle; and c.) a connecting means between the elongated handle and the porous cover piece on which said porous cover piece swivels for selectively covering the bristles of the toothbrush, wherein the elongated handle has "Fitting Groove(s)" for the connecting means to fit into, said connecting means becoming flush with said elongated handle when brushing action is taking place.

25. An apparatus, comprising:

a.) a toothbrush, comprising an elongated handle at one end and a bristled head at an other end with the handle further including a hollow storage chamber;

b.) a porous cover piece adapted to be stored in the hollow chamber when brushing action is taking place, having only one open side enabling the cover piece to be placed over the bristles, said cover piece having a non porous backside opposite the open side, and porous sides, wherein the porous sides are oriented such that they are generally parallel to the longitudinal axis of the handle; and c.) a connecting means between the elongated handle and the porous cover piece on which said porous cover piece swivels for selectively covering the bristles of the toothbrush; and wherein the cover piece is positioned onto a swivel means for rotating the cover piece on the connecting means, such that the open side of the cover piece faces the bristle head when brushing action is not taking place, and the open side faces a bottom of the hollow chamber when brushing action is taking place.

26. The apparatus of claim 25, wherein the swivel means for rotating is a pin or axle.

27. The apparatus of claim 26, wherein the pin or axle being either of the same piece as the connecting means, or a separate and distinguishable piece from the connecting means.

28. The apparatus of claim 27, wherein the pin or axle being adequate in length to span a width of the cover piece.

29. An apparatus, comprising:

a.) a toothbrush, comprising an elongated handle at one end and a bristled head at an other end;

b.) a porous cover piece, having only one open side enabling the cover piece to be placed over the bristles, said cover piece having a non porous backside opposite the open side, and porous sides, wherein the porous sides are oriented such that they are generally parallel to the longitudinal axis of the handle;

c.) a connecting means between the elongated handle and the porous cover piece on which said porous cover piece swivels for selectively covering the bristles of the toothbrush; and d.) a swivel means between the connecting means and the cover piece, wherein the connecting means and the cover piece have holes or fittings, on which the connecting means and the cover piece swivel, the cover piece being positioned on said swivel means for rotating the cover piece 360 degrees.

30. An apparatus, comprising:

a.) a toothbrush, comprising an elongated handle at one end and a bristled head at an other end, wherein the elongated handle has a hollow storage chamber;

b.) a porous cover piece adapted to be stored in the hollow chamber when brushing action is taking place, having only one open side enabling the cover piece to be placed over the bristles, said cover piece having a non porous backside opposite the open side, and porous sides, wherein the porous sides are oriented such that they are generally parallel to the longitudinal axis of the handle and wherein the cover piece and the storage chamber have a shape selected from the group consisting of a trapezoidal and a diamond shape; and c.) a connecting means between the elongated handle and the porous cover piece on which said porous cover piece swivels for selectively covering the bristles of the toothbrush.

* * * * *